United States Patent [19]

Barrett et al.

[11] 4,022,325

[45] May 10, 1977

[54] COLLAPSIBLE COLLATING RACK

[75] Inventors: Edward E. Barrett, Massapequa Park, N.Y.; Stephen J. Failla, Oradell, N.J.

[73] Assignee: Swingline, Inc., Long Island City, N.Y.

[22] Filed: Feb. 5, 1976

[21] Appl. No.: 655,496

[52] U.S. Cl. ..... 211/11; 211/202

[51] Int. Cl.[2] ..... A47F 5/08; B42F 17/00

[58] Field of Search ..... 211/195, 201, 202, 10, 211/11, 40, 41, 105; 248/150; 206/72, 73

[56] References Cited

UNITED STATES PATENTS

| | | | |
|---|---|---|---|
| 639,740 | 12/1899 | Kirby | 211/202 |
| 1,682,667 | 8/1928 | Eifel | 211/11 |
| 2,568,996 | 9/1951 | Evans | 211/10 |
| 3,327,869 | 6/1967 | Guhl et al. | 211/105 X |
| 3,490,603 | 1/1970 | Willer | 211/202 X |

*Primary Examiner*—Roy D. Frazier
*Assistant Examiner*—Terrell P. Lewis

[57] ABSTRACT

A collapsible rack is disclosed which comprises a plurality of partition members which are pivotally joined together at their bases with linking members to form an expandable lazy tong structure. A plurality of guide means which are each secured to and integral with the linking members are provided for guiding stacks of sheets placed in the rack. The guide means define slanted guide surfaces which extend between the bases of adjacent partition members. The guide surfaces all have a substantially common orientation on the linking members. The guide means also serve the function of improving the rigidity of the structure, defining back-up surfaces that insure the proper support of the sheets and fan the sheets into oblique relationship with each other enabling convenient removal of the sheets.

13 Claims, 8 Drawing Figures

COLLAPSIBLE COLLATING RACK

BACKGROUND OF THE INVENTION

The present invention relates to collapsible collating racks. More particularly, the invention is concerned with a collapsible collating rack made of elongated metal elements which have been bent and riveted to form the rack structure. This structure is particularly advantageous insofar as the final rack is extremely light in weight, and when collapsed, takes up a minimum of space.

In the past, although racks made of elongated metal elements have been designed, they have several distinct disadvantages. Typical prior art racks are disclosed in U.S. Pat. No. 2,556,996 to Evans and U.S. Pat. No. 3,327,869 to Guhl et al. These prior art devices, generally comprising a plurality of rectangular members which are secured together using a lazy tong configuration, suffer from a number of disabilities. For example, a disadvantage of prior art racks such as those described in the above-referenced patents is the tendency of the partition members to slant as the rack is expanded. Thus, if the rack is expanded to any significant extent, the partition members will be quite slanted, thus making insertion of material into the members somewhat inconvenient and time consuming. While some degree of slant is desirable, it is not desirable for that slant to be dependent on the degree of extension. Another disadvantage of prior art racks is the relatively complicated nature of their structure. Structures such as those described by Evans and Guhl et al illustrate the typically intricate rack structure requiring a relatively large number of elements and a large number of riveting points in order to form the entire structure. These structures suffer from inefficiencies due to the fact that many of the elements perform strictly structural functions, that is to say, they perform solely the function of maintaining the shape of the rack without contributing to the job of supporting the paper sheets. These particular structural inefficiencies contribute to greater costs both in assembly and in providing the raw material to form the rack. Ideally, one would prefer a structure in which all elements perform both structural and supportive functions.

An alternative collapsible collating device is illustrated in U.S. Pat. No. 1,682,667 to Eifel. This structure comprises a lazy tong base to which a plurality of projecting leaves are connected. This structure also suffers from a number of disabilities. For example, the projecting leaves are secured to the lazy tong structure using a rather complicated mechanical arrangement. Furthermore, the sheet guiding elements provided result in yet further complicating the structure.

SUMMARY OF THE INVENTION

In accordance with the present invention, a collapsible rack which solves many of the problems of the prior art is provided. The rack comprises a plurality of partition members including a first partition member, at least one intermediate partition member and a last partition member. Each of the partition members comprises an elongated base portion and a pair of side portions extending from the base portion. Each of the base portions has first and second points positioned along its length and a third point positioned between the first and second points. The partition members are positioned substantially in line with and in planes substantially parallel to each other. A first short linking member extends between the first of the partition members and an intermediate partition member. The first short linking member is pivotally secured to the first member at its third point and to the intermediate member at its first point. A plurality of long linking members are parallel to the first short linking member. Each has first and second points positioned along its length and a thrid point positioned between the first and second points. Each of the long linking members is pivotally secured at its third point to the third point on the base of one of the intermediate partition members and has its first point secured to the first point on the base of an adjacent partition member and has its second point pivotally secured to the base of the other adjacent partition member. A second short linking member is parallel to the long linking members and extends between and is pivotally secured to the second point on the base of the last of the intermediate partition members and the third point on the base of the last partition member. A plurality of guide means are provided which are each secured to and integral with the linking members. The guide means defines a slanted guide surface which extends between each adjacent pairs of points, at which the linking members are pivotally secured to the base portions. The guide surfaces all have a substantially common orientation on the linking members. The guide surfaces support the individual sheets in each stack inside the rack in oblique relationship with respect to each other. The guide means serves the additional function of improving the rigidity of the structure.

DETAILED DESCRIPTION OF THE PREFERRED EMBODIMENTS

Figure 1:
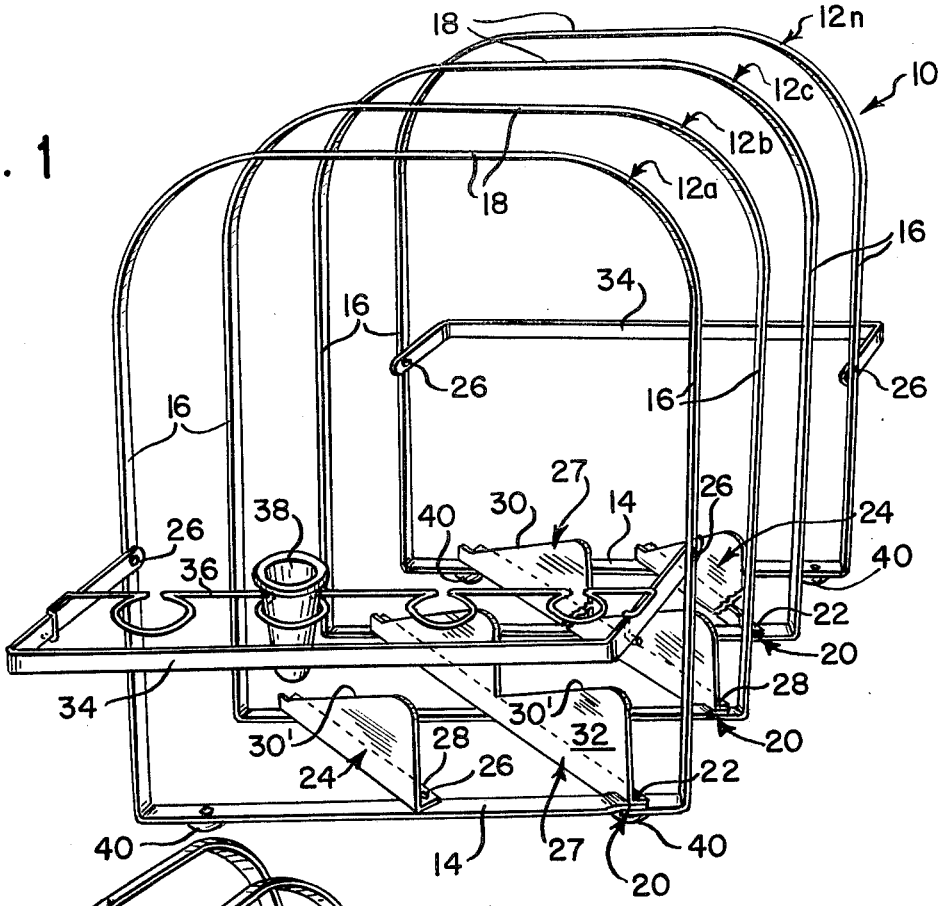
FIG. 1 is a front perspective view of a collapsible rack constructed in accordance with the present invention.

A collating rack 10 constructed in accordance with the present invention is illustrated in FIG. 1. Rack 10 is made of a plurality of partition members 12*a–n* which lie in planes generally parallel to each other. Each partition member 12*a–n* comprises a base portion 14, a pair of side portions 16 and a top portion 18. In accordance with the preferred embodiment, each partition member is made from a single elongated piece of stock metal which is bent into the desired form and joined upon itself at a point 20 and held in that position by rivets 22.

Insofar as partition members 12*a–n* lie in planes which are parallel to each other, bases 14 define a plane. Partition members 12*a–n* are so formed that they are tilted, that is to say, that the planes within which each of the partition members 12*a–n* is contained are skewed with respect to the plane defined by the base portions 14 of the partition members 12*a–n*. The partition members are secured together by a plurality of linking members. A short linking member 24 is pivotally secured between partition members 12*a* and 12*b* by rivets 26 which allow linking members 24 to rotatably pivot on base 14. Rivets 22 extend through holes 25 in the linking members securing them and rubber feet 40 to the bases 14. It is noted that all of the rivets which pass through base portions 14 serve at least the double purpose of forming the lazy tong structure and supporting a guide surface. Rivets 22 perform the additional function of holding the partition members closed. Insofar as the base portions 14 are thicker at point 20, that portion 29, of those linking members through which rivets 22 pass, is raised (FIG. 3).

Figure 3:
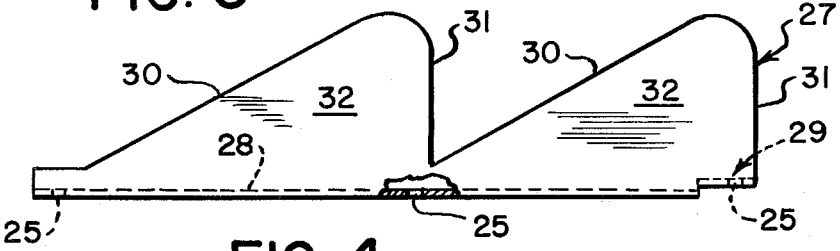
FIG. 3 is a plan view of one of the linking members of the rack of FIG. 1.
Figure 4:
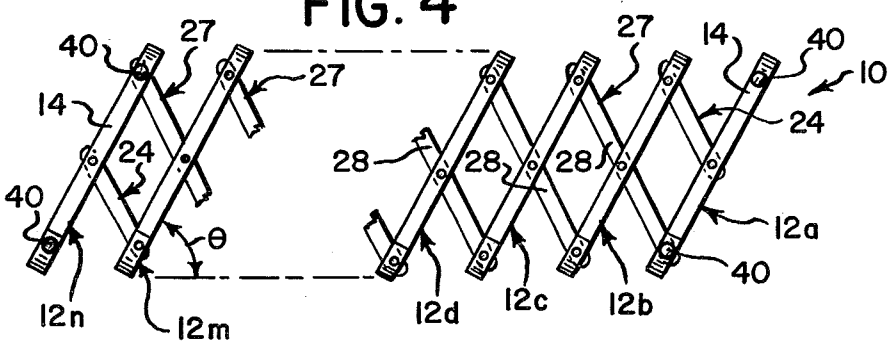
FIG. 4 is a bottom plan view of the rack illustrated in FIGS. 1 and 2.

A plan view of a typical linking member is shown in FIG. 3. This linking member includes a foot 28 shown in phantom lines, a slanted guide surface 30 and a backing guide surface 31 on a guide tongue 32. As can be seen from the figure, guide tongue 32 is integral with foot 28. The base portions 14 of the partition members 12*a–n* together with feet 28 of the linking members 24 and 27 form an expandable lazy tong structure as is illustrated most clearly in FIG. 4. It is also noted that the combination of the tongues 32 and feet 28 in a single integral piece at an angle of 90° with respect to each other gives the structure exceptional rigidity. Insofar as the guide surfaces 30 are arranged with a common orientation with respect to each other, two such guide surfaces such as surfaces 30' which are disposed between the bases of partition members 12*a* and 12*b* lie in a common plane which is skewed with respect to the plane of the base portions 14 in a direction extending toward partition member 12*a*. Thus, the plane defined by any pair of guide surfaces 30 which extend between pairs of points on adjacent partition members define a plane which is skewed with respect to the plane defined by the base portions of the partition members in the direction opposite the direction in which the plane which contains the partition members is skewed.

For the sake of convenience, a pair of U-shaped handle members 34 are pivotally secured to the first and last partition members by rivets 26. A rubber finger grip holder 36 is provided for holding one or a number of rubber finger gripping elements 38. Finally, if desired, the rack may be provided with a plurality of rubber feet 40.

Figure 2:
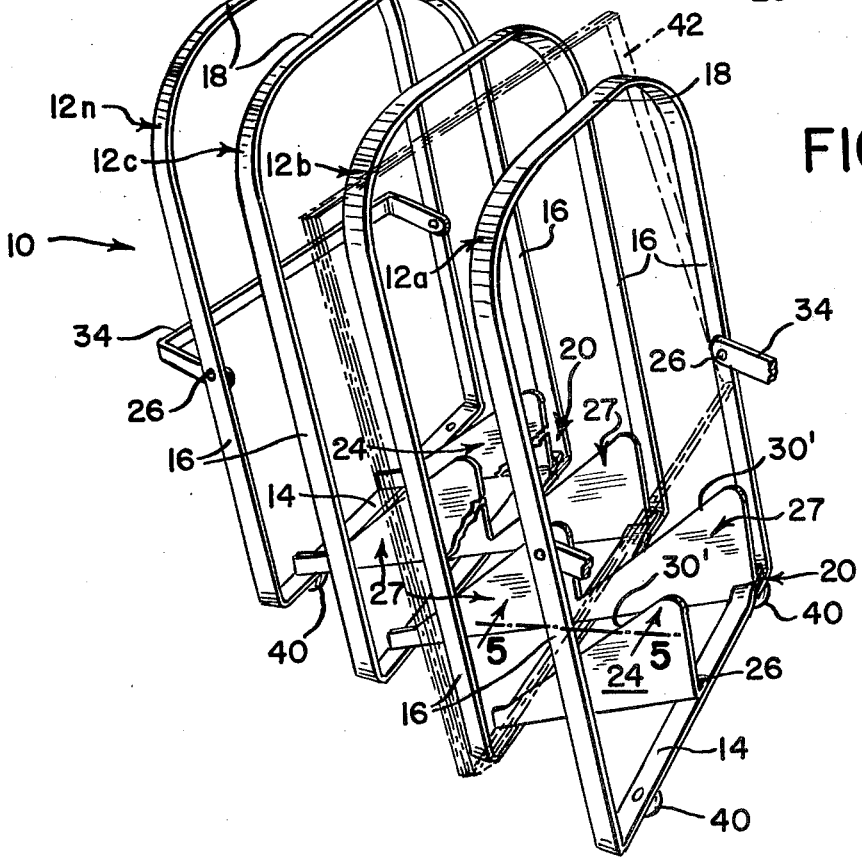
FIG. 2 is a side perspective view of the rack illustrated in FIG. 1 with one of the side handles and a finger grip holder removed and a stack of paper within it.
Figure 5:
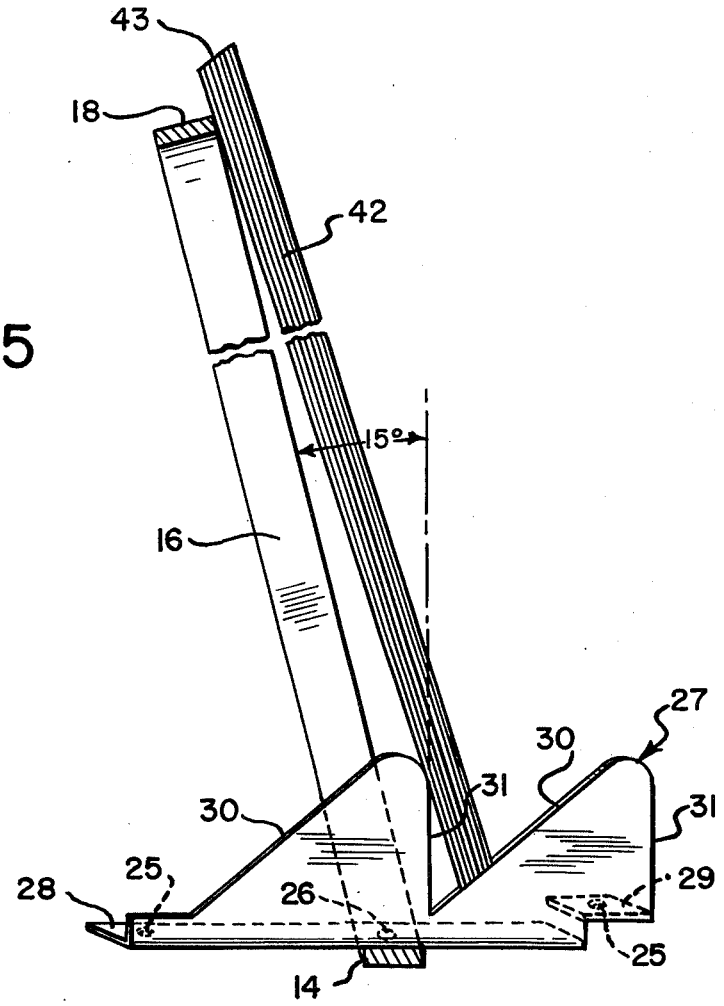
FIG. 5 is a perspective view of part of the rack along lines 5—5 of FIG. 1.

In use, a plurality of stacks of sheets of paper 42 would be placed between adjacent partition members. Such a stack is illustrated in FIG. 2. The stack is held in position by backing surface 31 and slanted guide surface 30, resulting in the tops 43 of sheets 42 being held in oblique relationship with respect to each other (FIG. 5). This, together with the fact that the elements are at an acute angle $\theta$ (FIG. 4) with respect to the front side of the overall rack structure, results in positioning the stacks of sheets in a manner which permits easy removal as well as convenient access. When it is desired to collate a number of stacks of sheets, each of the stacks would be put in one of the compartments defined between adjacent partition members. The individual performing the collating would then remove one of the sheets successively from each of the compartments, stacking them together, allowing them to be stapled, bound, and so forth.

Figure 6:
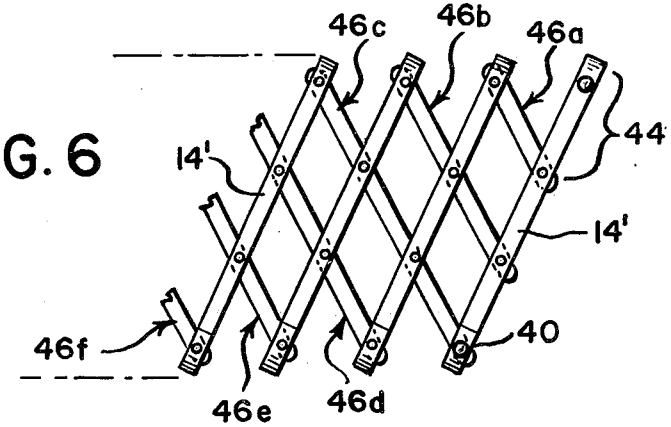
FIG. 6 is a bottom plan view of an alternative embodiment of a rack constructed in accordance with the present invention.
Figure 7:
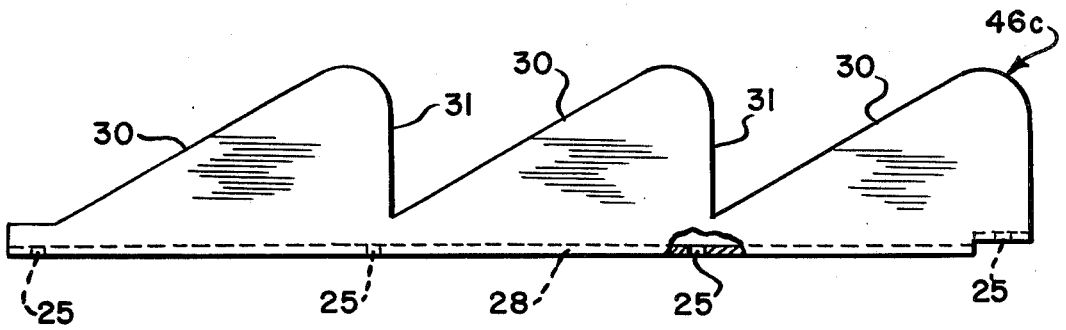
FIG. 7 is a plan view of one of the guide elements of the rack illustrated in FIG. 5.

Referring to FIG. 6, partition members having larger bases may be employed. The operation and construction of such a structure is substantially identical to that of the structure illustrated in FIGS. 1–5 with the exception that the bases 14' extend an additional length 44. Likewise, the structure employs linking members 46*a–f* which include more guide surfaces 30 than the embodiment illustrated in FIGS. 1–5. A typical intermediate linking member 46*c* is illustrated in plan in FIG. 7.

Figure 8:
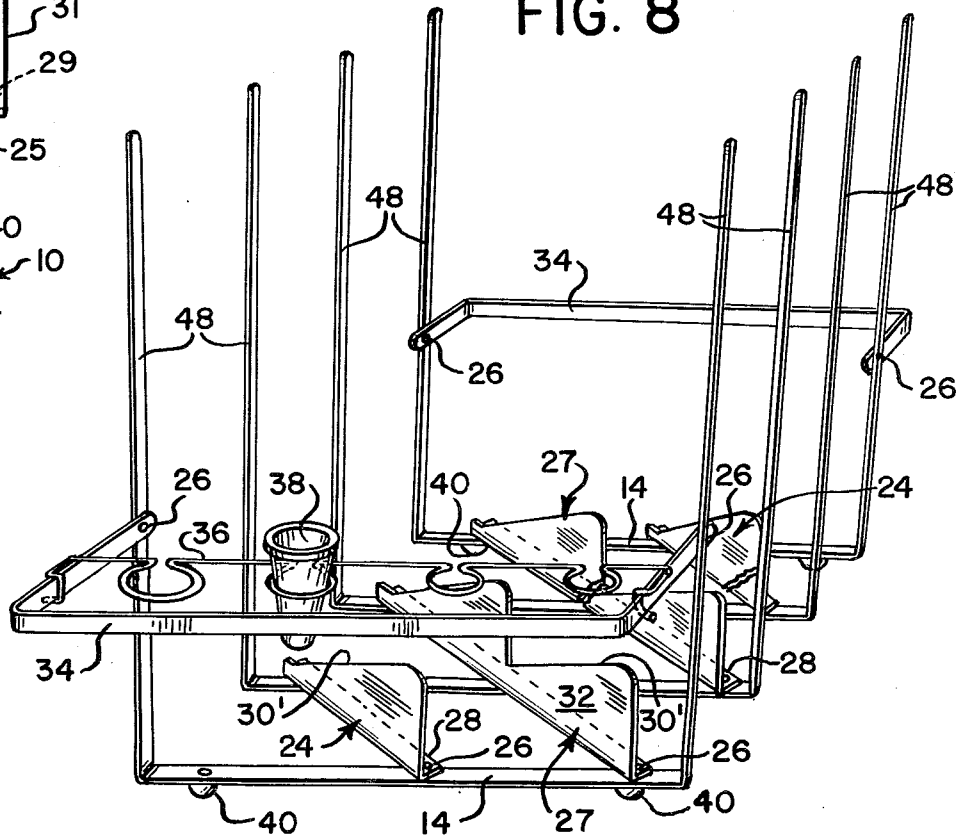
FIG. 8 is a perspective view of yet another embodiment of the invention.

Still yet another embodiment of the invention is illustrated in FIG. 8. The structure and operation of this embodiment is substantially identical to that of the embodiment in FIGS. 1–5 and the same numerals have been used to designate equivalent parts. The primary difference between these two embodiments is that the partition members in FIG. 8 do not include top portions 18. Instead, they include a plurality of elongated straight side portions 48. Another difference in the embodiment illustrated in FIG. 8 is that there is no need to have a raised portion such as portion 29 in the embodiment illustrated in FIG. 1 because the partition element is not a closed loop.

While a preferred embodiment of the invention has been disclosed, it is understood that various modifications will be obvious to those of ordinary skill in the art. Such modifications are within the spirit and scope of the invention as limited and defined only by the appended claims.

We claim:

1. A collapsible rack comprising:

a. a plurality of partition members including a first partition member, at least one intermediate partition member and a last partition member, each of said partition members comprising an elongated base portion and a pair of side portions extending from said base portion, each of said base portions having first and second points positioned along its length and a third point positioned between said first and second points, said partition members being positioned substantially in line with and in planes substantially parallel to each other;

b. a first short linking member extending between the first of said partition members and an intermediate partition member, said first short linking member being pivotally secured to said first member at its third point and to said intermediate member at its first point;

c. a plurality of long linking members parallel to said first short linking member, each having first and second points positioned along its length and a third point positioned between said first and second points, each of said long linking members being pivotally secured at its third point to the third point on the base of one of said intermediate partition members, having its first point secured to the first point on the base of an adjacent partition member and having its second point pivotally secured to the base of the other adjacent partition member;

d. a second short linking member parallel to said long linking members and extending between and pivotally secured to the second point on the base of the last of said intermediate members and the third point on the base of the last partition member; and e. a plurality of guide means for defining a plurality of slanted guide surfaces extending between each adjacent pair of points at which said linking members are pivotally secured to said base portions, said guide surfaces all having a substantially common orientation.

2. A collapsible rack as in claim 1, wherein the vertical projection of said second point of said first partition on said first intermediate partition member lies between the second and third points of said first intermediate partition member.

3. A collapsible rack as in claim 2, wherein:

a. each of said partition members extends from said first point through said third point and through and beyond said second point to a fourth point; and b. the linking member pivotally secured to the base of any given partition member at its third point, said given partition member being one that is separated from a second given partition member by a third given partition member, extends from its third point beyond its second point to a fourth point which is rotatably secured to the fourth point of said second given partition member; and further comprising:

a. an additional linking member secured between the fourth point on the last intermediate partition member and the second point on the last partition member; and b. additional guide means each secured to and integral with that portion of said linking members extending between said second and fourth points on said linking members, and defining a slanted guide surface extending between said second and third points on said linking members and said guide surfaces having an orientation substantially common with the other guide surfaces.

4. A collapsible rack as in claim 1, wherein said partition members further comprise an elongated top portion secured between the upstanding ends of said side portions, thereby resulting in a plurality of partition members generally in the form of closed loops.

5. A collapsible rack as in claim 4, wherein the interface of said top portions and said side portions is in a curved configuration.

6. A collapsible rack as in claim 5, wherein said partition members are made from a single elongated metal stock element bent to form said base portion, side portions and top portions and joined upon itself at the center of said top portions to form said closed loop.

7. A collapsible rack as in claim 4, wherein said guide means are made from a single element defining an elongated foot portion and an asymmetrical tongue upstanding therefrom.

8. A collapsible rack as in claim 4, wherein said partition members lie in planes which are parallel with respect to each other but which are skewed with respect to the plane defined by said base portions.

9. A collapsible rack as in claim 8, wherein the slanted guide surfaces which extend between adjacent pairs of points on two adjacent partition members define a plane which is skewed with respect to the plane defined by the base portions of the partition members in a direction opposite the direction in which the plane which contains the partition members is skewed.

10. A collapsible rack as in claim 4, further comprising a pair of generally U-shaped handle members secured to the side portions of said first and last partition members.

11. A collapsible rack as in claim 10, further comprising means for supporting rubber fingers, said means being secured to one of said handle members.

12. A collapsible rack as in claim 4, wherein the planes defined by the partition members are at an acute angle with respect to the plane defined by the side portions adjacent said first points.

13. A collapsible rack as in claim 1, wherein said plurality of guide means are secured to and integral with said linking members.

* * * * *